US005144827A

United States Patent [19]

Iio

[11] Patent Number: 5,144,827

[45] Date of Patent: Sep. 8, 1992

[54] ROLLING MILL STAND

[75] Inventor: Itsushi Iio, Niihama, Japan

[73] Assignee: Sumitomo Heavy Industries, Ltd, Tokyo, Japan

[21] Appl. No.: 731,172

[22] Filed: Jul. 11, 1991

[30] Foreign Application Priority Data

Jul. 12, 1990 [JP] Japan ..... 2-184833

[51] Int. Cl.[5] ..... B21B 13/12; B21B 31/26; B21B 35/12

[52] U.S. Cl. ..... 72/224; 72/248; 72/249

[58] Field of Search ..... 72/224, 248, 249, 225, 72/237

[56] References Cited

U.S. PATENT DOCUMENTS 3,861,187 1/1975 Leeuwestein ..... 72/248
4,569,217 2/1986 Properzi ..... 72/248

FOREIGN PATENT DOCUMENTS 54-3469 2/1979 Japan .
63-93403 4/1988 Japan .
0391872 7/1973 U.S.S.R. ..... 72/224
0401431 10/1973 U.S.S.R. ..... 72/224
0409749 1/1974 U.S.S.R. ..... 72/224
0933137 6/1982 U.S.S.R. ..... 72/224

*Primary Examiner*—Lowell A. Larson
*Assistant Examiner*—Thomas C. Schoeffler
*Attorney, Agent, or Firm*—Armstrong, Nikaido, Marmelstein, Kubovcik & Murray

[57] ABSTRACT

The present invention is to provide a compact roll stand apparatus, particularly of four-roll type, comprising both a roll parting adjustment device and an all-roll drive device. Further in detail, a roll stand apparatus comprising: a plurality of grooved rolls arranged radially, with substantially same degree intervals, from the pass line along which material bars and rods are driven, and whose rotational axes lie on a plane; eccentric shafts each rotatably supporting each of said grooved rolls; a device for simultaneously rotating said eccentric shafts and also simultaneously adjusting radial distances from said pass line to the rotation axes of said grooved rolls; driven gears each mounted concentric with the rotation shaft of each of said grooved rolls so as to rotate integrally with each of said grooved rolls; driving gears whose rotation axes lie on a plane apart, in the direction of said pass line, from said plane where the axes of said grooved rolls lie, and which engage with said driven gears; and a drive device for simultaneously rotating said driving gears.

6 Claims, 6 Drawing Sheets

ROLLING MILL STAND

BACKGROUND OF THE INVENTION

1. Field of the Invention

The present invention relates to a roll stand apparatus for rolling materials with circular or angular profiles, particularly bars and rods.

2. Description of the Related Art

There have been three types of finish rolling apparatuses for bars and rods; a two-roll type in which the two grooved rolls are arranged symmetrically with the center being the pass line of the material to be rolled; a three-roll type in which the three grooved rolls are arranged radially from the pass line with 120-degree intervals, as described in Japanese Patent Examined Publication No. 54-3469; and a four-roll type in which the four grooved rolls are arranged radially from the pass line with 90-degree intervals, as described in Japanese Patent Unexamined Publication No. 63-93403.

The two-roll type of finish rolling apparatus has a simple structure and facilitates the changing of rolls. However, it requires many kinds of finish rolls since the roll grooves at the final finish roll stand must have substantial semicircular profiles. Also, when the materials have slightly different diameters and have to be rolled by the same grooved rolls with the help of a rolling-reduction adjustment, the two-roll type provides poorer rolling precision than the three and four-roll types since such grooves in the two-roll type have smaller relief angles.

The three-roll type of finish rolling apparatus is provided with all-roll drive means and rolling-reduction adjusting means (hereinafter referred to as "parting adjustment means"). Consequently, while all the rolls are driven by one single drive-input shaft, the parting can be adjusted.

The four-roll type of finish rolling device has the largest relief-angles and provides the rolling-precision superior to the three types. The four-roll type is provided with parting adjustment means but not with roll driving means, so that it requires the upstream rolling device to drive materials. With this type, the heads of materials, bars and rods, are likely to be stopped at the roll gap, and high speed (60 to 100 m/s) rolling or narrow material (10 to 5 mm in diameter) rolling is not efficiently carried out. To obtain as much reduction of area as possible, the rolls have to be larger to provide smaller contact angles, which will make the stop more likely.

Recently, rolled bars and rods with high precision are demanded in the market. The demand goes up to a quarter or less of the dimensional tolerance by JIS, e.g. ±0.1 mm or less in a diameter of 5.5 to 20 mm. The inventors have aimed at a four-roll rolling mill as the basic concept of a rolling device which is developed to perform high speed rolling and high rolling precision. The conventional four-roll type, as described above, is provided with parting adjustment means but not with roll drive means. Therefore, its features, such as high precision rolling, have not been fully utilized.

The conventional three-roll type provided with the parting adjustment means and the all-roll drive as in Japanese Patent Examined Publication No. 54-3469 has been worked on to be modified into a four-roll type. In such modification, the space for the driving bevel gears is difficult to obtain if four rolls are arranged in accordance with the design of the three-roll type. Or, to obtain the space in the conventional structure, larger rolls inevitably have to be employed to widen the distance between the roll axes, causing a greater rolling reaction force and resulting in a larger roll stand. The conventional three-roll type structure comprising both the parting adjustment means, including planet and sun gears, and the all-roll drive means, including bevel gears, can not be applied to a compact four-roll stand.

SUMMARY OF THE INVENTION

The object of the present invention is to provide a compact rolling mill stand provided with multi grooved rolls, the roll parting adjustment means and the all-roll drive means, and which is capable of rolling bars and rods with high speed and high precision.

The present invention provides a roll stand apparatus of a rolling mill, comprising:

- a plurality of grooved rolls arranged radially with substantially same degree intervals from the pass line along which material bars and rods are driven, and whose rotational axes lie on a first plane;
- eccentric shafts each rotatably supporting each of said grooved rolls;
- means for simultaneously rotating said eccentric shafts and also simultaneously adjusting radial distances from said pass line to the rotation axes of said grooved rolls;
- driven gears each mounted concentric with the rotation shaft of each of said grooved rolls so as to rotate integrally with each of said grooved rolls;
- driving gears whose rotation axes lie on a second plane apart, along said pass line, from said first plane where the axes of said grooved rolls lie, and which engage with said driven gears;
- and drive means for simultaneously rotating said driving gears.

Thus, the space is obtained for the bevel gears which are provided on the shafts of driving gears so as to simultaneously rotate all the driving gears, by means of laying the axes of the driving gears and the axes of the grooved rolls and the driven gears on two different planes apart from each other along the pass line.

DETAILED DESCRIPTION OF THE PREFERRED EMBODIMENTS

Figure 1:
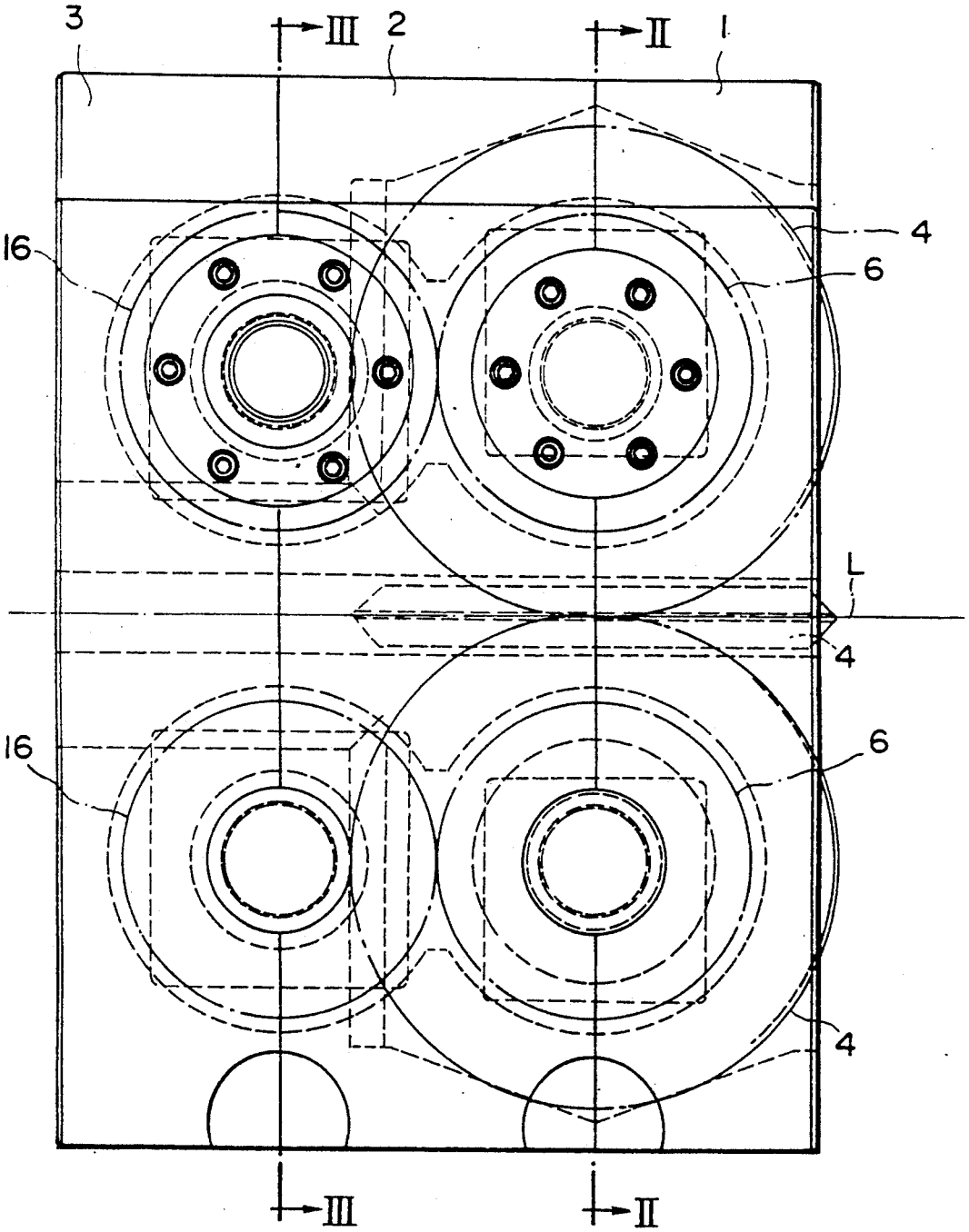
FIG. 1 is an elevational view of an embodiment of the present invention applied in a four-roll stand.

As shown in FIG. 1, a roll stand in this invention comprises three housing parts 1, 2, 3 with attaching surfaces II—II, III—III.

Figure 2:
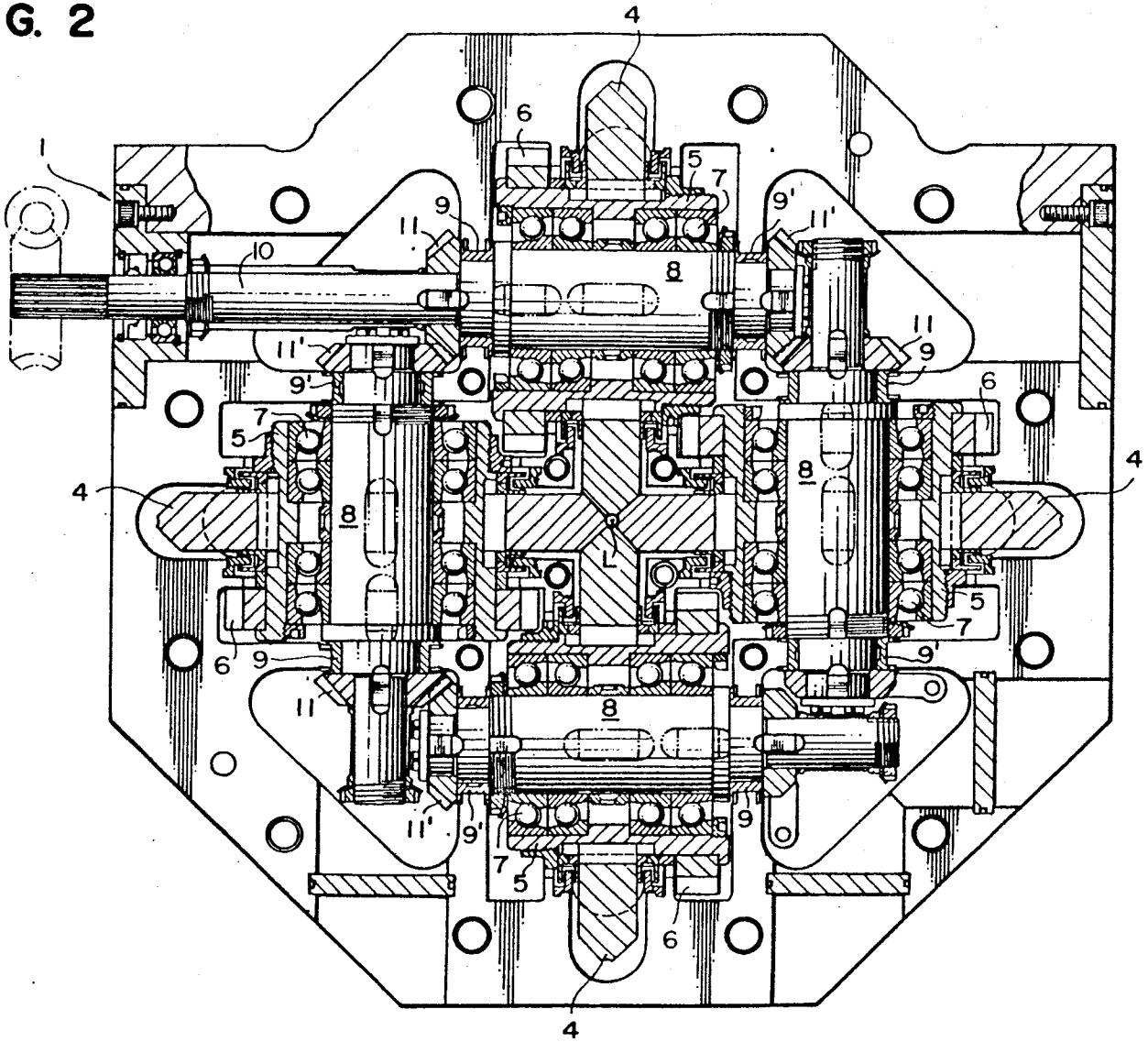
FIG. 2 is a cross section taken along line II—II of FIG. 1 and viewed in the direction of the arrow.

Referring to FIG. 2, there can be seen a cross-shape space with the center being the pass line L, in which four grooved rolls 4 are arranged with their rotation axes lying to substantially form a square on the plane between the housing parts 1 and 2. Each grooved roll 4 is keyed to a hollow shaft 5 which is rotatably supported through ball bearings 7 by an eccentric shaft 8, and a driven helical gear 6 is concentrically keyed to the hollow shaft 5. Each eccentric shaft 8 has at its ends neck portions whose center is shifted a certain amount from that of the eccentric shaft, and which are rotatably journaled by way of bushes 9, 9' to the housing parts 1, 2. An adjustment shaft 10 is extended from one of the necked ends of the eccentric shafts 8 (the top one in FIG. 2). The parting adjustment is carried out as follows. By slightly rotating the adjustment shaft 10, the center b, shown in FIG. 4, of the eccentric shaft 8, the grooved roll 4 and the driven helical gear 6 moves along a circular arc centered at point a. In this way, the rotation axis of the grooved roll 4 shifts in the radial direction of the material bar or rod during rolling, towards or away from the pass line.

Bevel gears 11, 11' are keyed to the necked ends of each eccentric shaft 8. A bevel gear 11 of one eccentric shaft engages with the bevel gear 11' of the neighboring shaft arranged in right angle to the former shaft. As a result, by slightly rotating the adjustment shaft 10, all the eccentric shafts synchronously rotate slightly and all the grooved rolls shift slightly in the radial direction of the material under rolling. There are no bevel gears between the bottom and right-hand-side eccentric shafts, shown in FIG. 2, since the rotation is transmitted from the left-hand-side and top shafts through the bevel gears to both shafts respectively.

Figure 3:
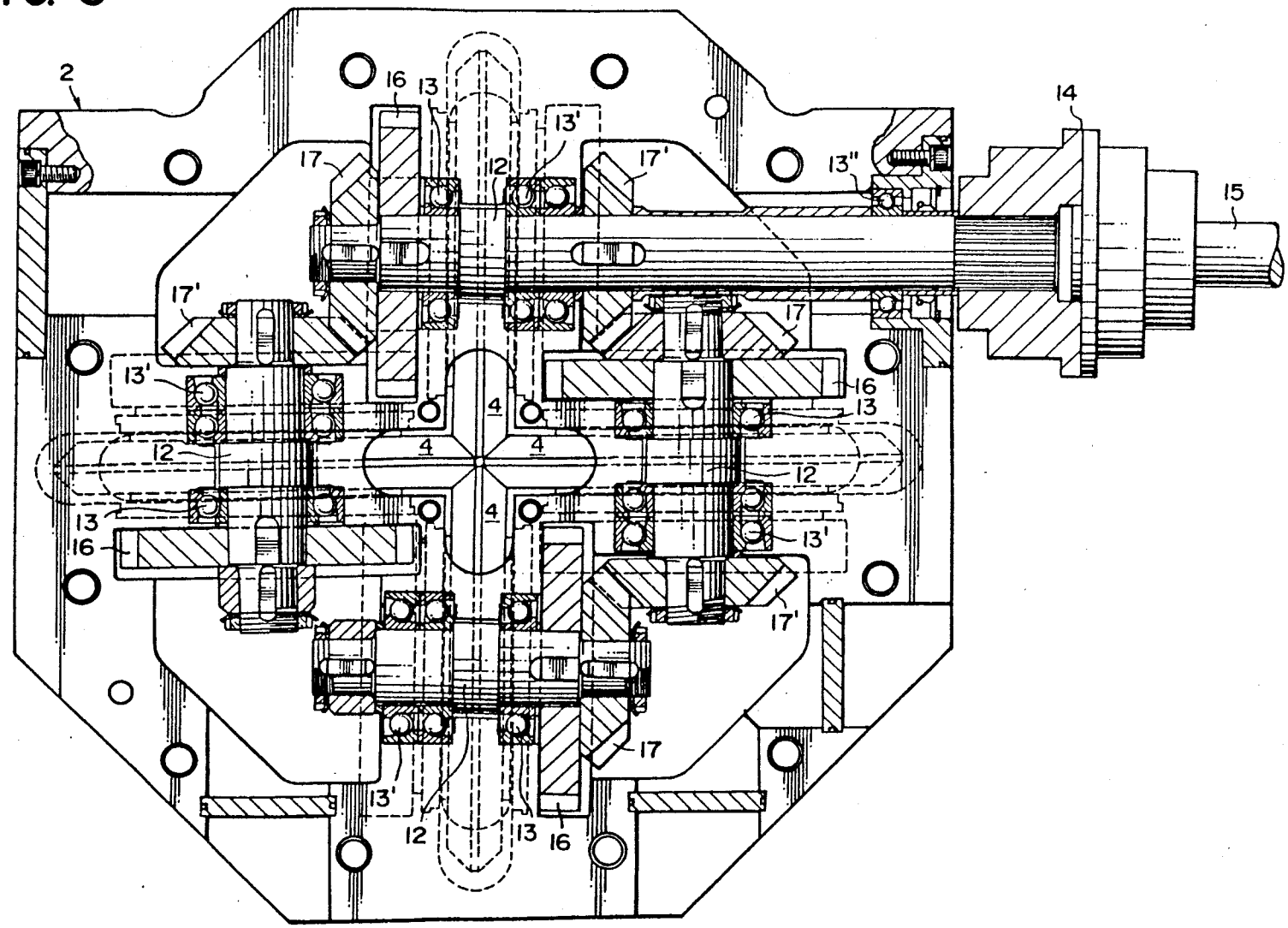
FIG. 3 is a cross section taken along line III—III of FIG. 1 and viewed in the direction of the arrow.

Now referring to FIG. 3, four roll-driving shafts 12 are arranged in a substantial square with their axes lying on the plane between the housing parts 2 and 3. Each roll-driving shaft is rotatably supported by ball bearings 13, 13'. The top roll-driving shaft 12 is also supported by a ball bearing 13'' at the shaft extension toward the right hand side. The end of the extension is connected by way of shaft coupling 14 to a drive shaft 15 of a distribution speed reducer or increaser (not shown). Keyed to each roll-driving shaft 12 is a driving helical gear 16 which engages with the driven helical gear 6 shown in FIG. 2. Driving bevel gears 17, 17' abutting to the end sides of the driving helical gears 16 and the ball bearings 13' respectively are keyed to both right and top roll-driving shafts 12. Keyed to the left roll-driving shaft is only a driving bevel gear 17' abutting to the upper side of the ball bearing 13', and keyed to the bottom roll-driving shaft is only a driving bevel gear 17 abutting to the right side of the driving helical gear 16. The driving bevel gears 17, 17' on one roll-driving shaft 12 engage with the driving bevel gears 17', 17 on right-angled neighboring roll-driving shafts, so that all the roll driving shafts 12 rotate synchronously. The rotation of each roll-driving shaft 12 is transmitted by way of the driving and driven helical gears 16, 6 to the grooved roll 4. As the result, the drive force of the drive shaft 15 is transmitted to all the roll-driving shafts 12, and all the driving helical gears 16 synchronously rotate, and then, by way of the driven helical gears 6, the drive force is transmitted to rotate all the grooved rolls 4.

Figure 4:
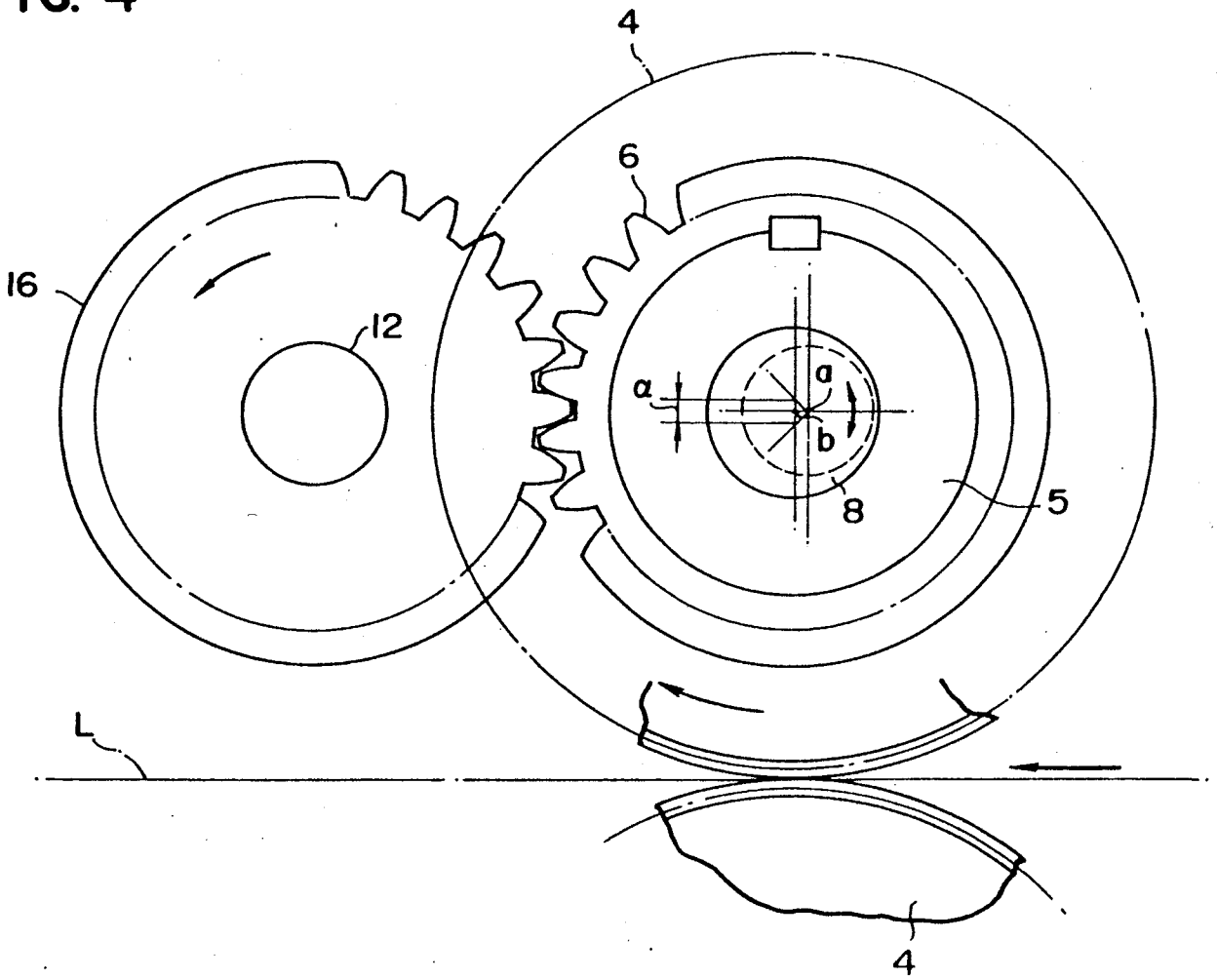
FIG. 4 is an enlarged view illustrating the eccentric shift of the eccentric shaft for parting adjustment and the meshing of the driving and driven roll helical gears.

With reference to FIG. 4, while the rotation axis of a driving helical gear 16 is stationed, the rotation axis b of the driven helical gear 6 will be moved along a circular arc centered at point a by rotating the eccentric shaft for the parting adjustment. The drawing of FIG. 4 illustrates the eccentric shaft 8 being at the top dead center, or the driven helical gear 6 being at the median of the parting adjustment range. The distance between the axes of the driving and driven helical gears 16, 6 in this position provides the best gear-engagement, where the reference circles of both gears touch. When the eccentric shaft 8 is shifted up or downwards from the position shown in FIG. 4 for the parting adjustment, the distance between the axes of the driving and driven helical gears 16, 6 becomes slightly greater and the backlash of the gears will increase. However, this change is not so big as to substantially affect the gear engagement, and the parting adjustment can be carried out without affecting the torque transmission even in high speed rolling. The parting adjustment range is indicated by $\alpha$ in FIG. 4.

The profiles of the housing parts 1, 2, 3 viewed in the direction perpendicular to the pass line L are preferably octagonal, so that when a plurality of the four-roll stand are placed in line, with every other stand tilted 45 degrees in order to eliminate such surface portions of the material that are not directly pressed by the rolls, the bases with the same profile can be employed to support the stands.

Although the present invention has been described above as to the embodiment of an four-roll stand, this invention can also be applied to a three or two-roll stand.

Figure 5:
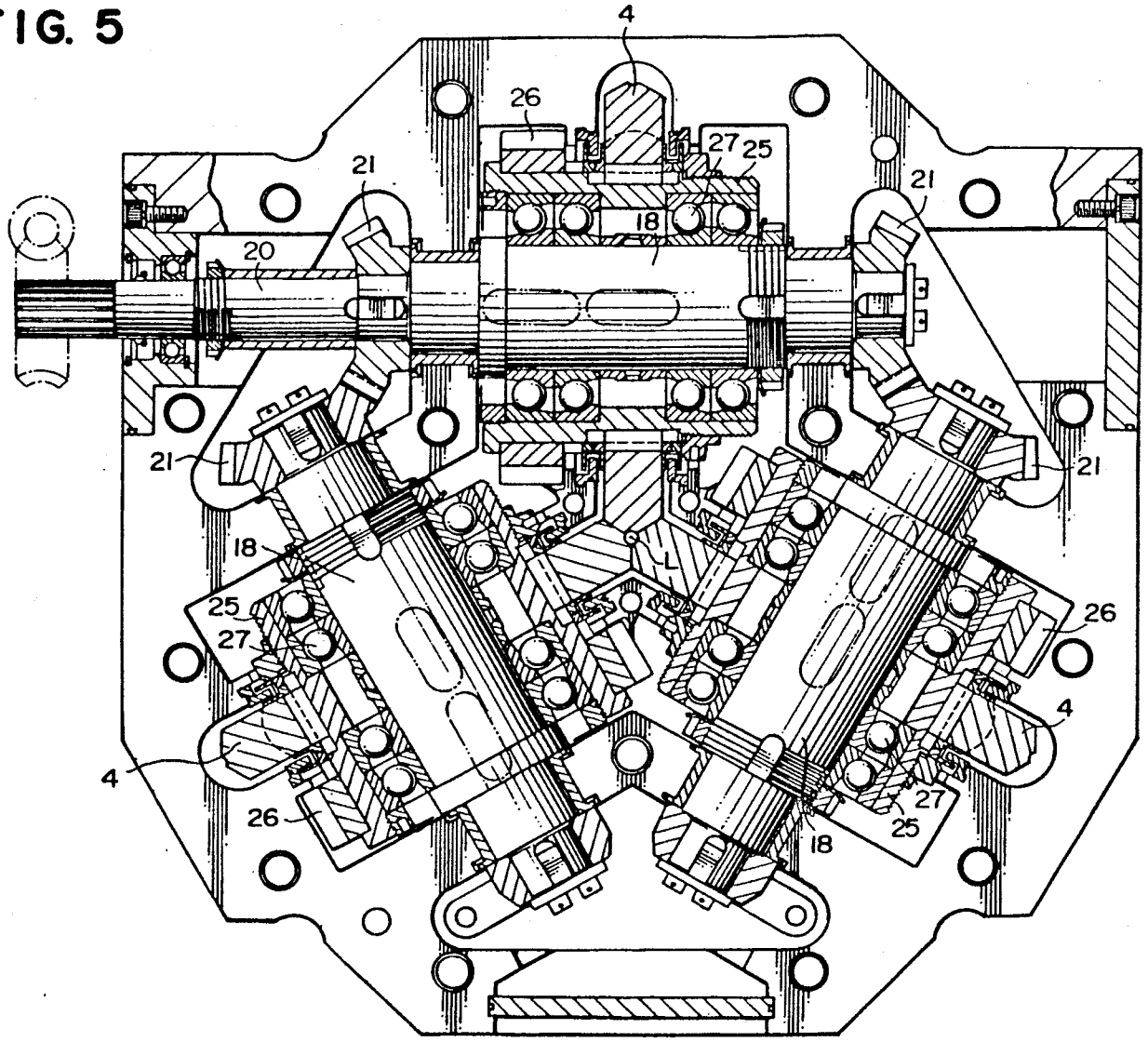
FIGS. 5 and 6 are cross sections taken on two different planes of an embodiment of the present invention applied in a three-roll stand, illustrating the parting adjustment means and the roll drive means respectively.
Figure 6:
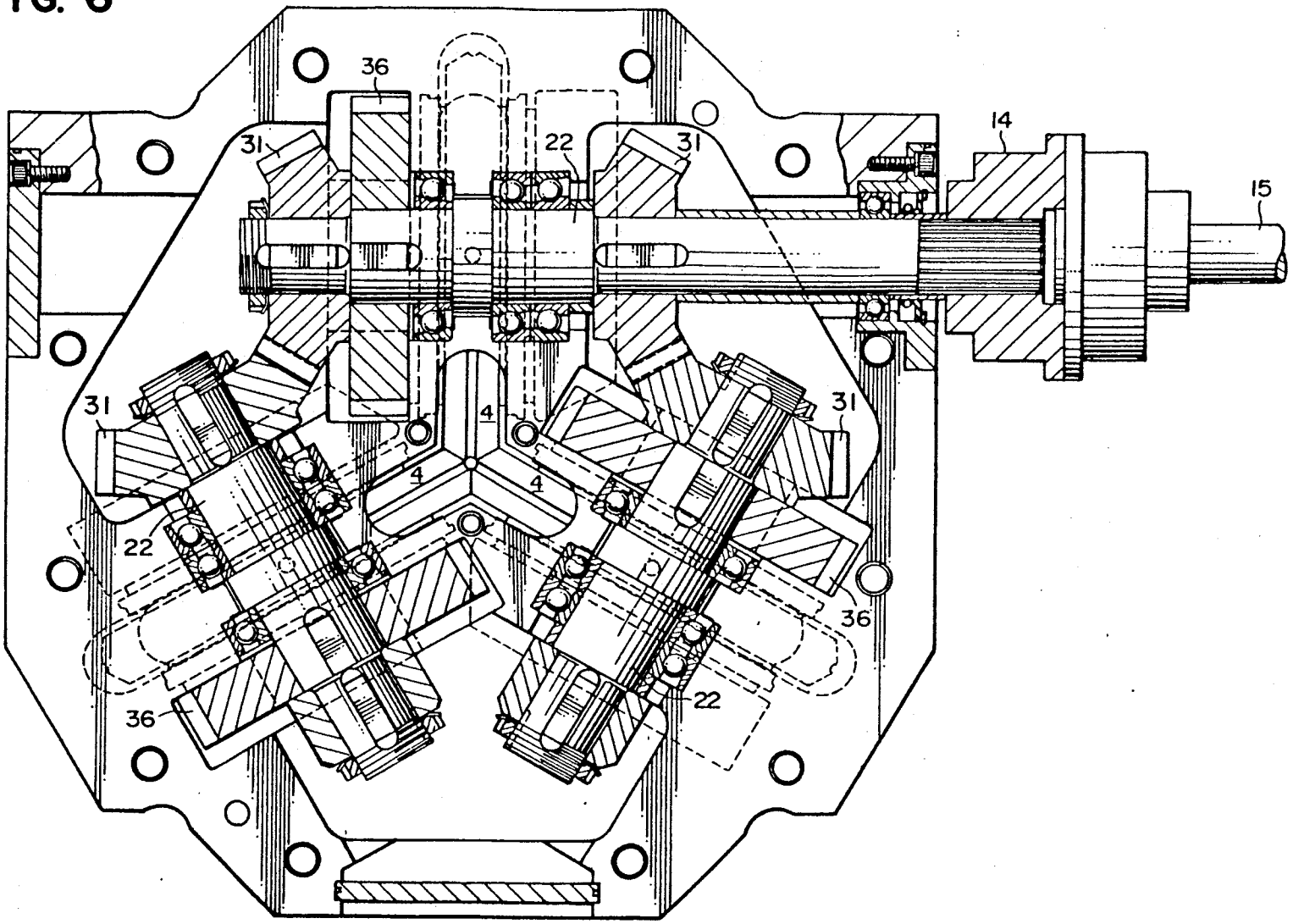

As illustrated in FIGS. 5, 6, a three-roll stand of this invention is the same way structured and operated as the four-roll stand shown in FIGS. 2, 3, except that the three rolls are arranged radially from the pass line L with 120 degrees intervals.

Referring to FIG. 5, three eccentric shafts 18 are drivingly connected by way of bevel gears 21. Each eccentric shaft 18 rotatably supports a hollow shaft 25 through ball bearings 27 provided around the eccentric shaft 18. Keyed to each hollow shaft 25 are a grooved roll 4 and a driven helical gear 26. One of the eccentric shafts 18 is provided with an adjust shaft 20 as an integral extension. By slightly rotating the adjustment shaft 20, all of the eccentric shafts 18 rotate eccentrically at the same time for the parting adjustment of the grooved rolls 4.

Now referring to FIG. 6, three roll-driving shafts 22 are interconnected by way of bevel gears 31. Keyed to each roll-driving shaft 22 is a driving helical gear 36 which engages with the driven helical gear 26 shown in FIG. 5. One of the roll-driving shafts 22 is connected by way of coupling 14 to a driven shaft 15. The torque of the drive shaft 15 rotates all the roll-driving shafts 22 and, by way of the engagement of the helical gears 36, 26, rotates the hollow shafts 25. In this way, the torque is transmitted to all the grooved rolls 4.

As apparent in the description of the embodiments above, this invention will provide a roll stand comprising both the parting adjustment means and the all-roll drive means in a simple structure.

Although the helical gears are employed for transmitting torque from the roll-driving shafts to the grooved rolls in the embodiments illustrated in the drawings, other type gears such as ordinary spur gears can replace the helical gears to embody this invention, obviously to the people in this field.

The present invention provides various advantages:

1. This invention provides a four-roll stand which comprises both the parting adjustment means and the all-roll drive means so as to be able to roll bars and rods with high precision and high speed.
2. The invention facilitates lay-out of the elements and enables an all-roll drive type stand to comprise more than three rolls and a more simplified structure, since the parting adjustment means and the roll drive means, in this invention, are arranged on two different planes apart from each other in the direction of the pass line.

3. A four-roll stand comprising all-roll drive means in a compact structure provides high rigidity, stable rolling with the material along the pass line and highly precise rolling. Such a four-roll stand can be employed for sizing the materials.

4. Since the housing of a four-roll stand is shaped octagonal, the roll stands of one design can be lined in tandem without having to provide roll stands specifically designed for V. H. stands. Also, changing roll-stands will be quick and easy since the roll-stand has only one drive input shaft.

5. The single parting adjustment shaft has a structure capable of the on-line rolling reduction, which facilitates automatic roll-position control and automatic roll-gap control.

6. A four-roll stand in this invention has in its features high precision rolling and a broad range of adapting grooved rolls of one design to the diameter difference of materials by means of rolling reduction adjustment. These features enable the four-roll stand to be employed as a stretch reducer in production of seamless steel pipes.

7. A four-roll stand in this invention can roll materials with rectangular profiles or shape steel if the parting adjustment means is designed so that rolls shift synchronously with facing counterparts, but not with neighboring ones, to adjust the roll parting.

What is claimed is:

1. A rolling mill roll stand having a pass line along which metal bars and rods are driven comprising:

a housing;

a plurality of eccentric shafts mounted to said housing by journals at each end of each eccentric shaft for eccentric rotary movement;

a plurality of bevel gears drivingly connecting one end of each of said eccentric shafts to an end of an adjacent eccentric shaft;

a plurality of grooved rolls arranged radially at substantially equal angle intervals around said pass line, means rotatably supporting each of said grooved rolls on one of said eccentric shafts for rotation about an axis with the rotational axes of said grooved rolls lying in a first plane;

a plurality of driven gears with each driven gear mounted concentric with the rotational axis of one of said grooved rolls to rotate said grooved roll;

a plurality of roll-driving shafts mounted to said housing; each of said roll-driving shafts being rotatable on an axis of rotation which lies in a second plane spaced from said first plane along a length of said pass line;

a second plurality of bevel gears with each bevel gear of said second plurality of bevel gears fixed to the end of one of said roll-driving shafts and engaging a bevel gear fixed to the end of an adjacent roll-driving shaft to drivingly connect each of said roll-driving shafts to an adjacent roll-driving shaft;

a plurality of driving gears, each of said driving gears being mounted for rotation with one of said roll-driving shafts and drivingly engaging one of said driven gears;

means for rotating said eccentric shafts connected by said bevel gears to simultaneously adjust a radial distance between said pass line and said rotational axes of said grooved rolls; and drive means for rotating said roll-driving shafts connected by said second plurality of bevel gears to simultaneously rotate said plurality of drive gears and said grooved rolls.

2. A roll stand as defined by claim 1, wherein said means for rotating said eccentric shafts is an extension of one of said journaled eccentric shafts.

3. A roll stand as defined by claim 1, wherein said drive means for rotating said roll-driving shafts comprises a drive shaft and a coupling connecting said drive shaft to one end of a roll-driving shaft.

4. A roll-stand as defined by claim 1, wherein said driven and driving gears are helical gears.

5. A roll-stand as defined by claim 1 or 4, wherein said plurality of grooved rolls comprise three of said grooved rolls arranged radially with 120 degree intervals.

6. A roll-stand as defined by claim 1 or 4, wherein said plurality of grooved rolls comprise four of said grooved rolls arranged radially with 90 degree intervals.

* * * * *